US010728690B1

(12) United States Patent
Satongar et al.

(10) Patent No.: US 10,728,690 B1
(45) Date of Patent: Jul. 28, 2020

(54) HEAD RELATED TRANSFER FUNCTION SELECTION FOR BINAURAL SOUND REPRODUCTION

(71) Applicant: Apple Inc., Cupertino, CA (US)

(72) Inventors: Darius A. Satongar, Santa Clara, CA (US); Jonathan D. Sheaffer, San Jose, CA (US); Martin E. Johnson, Los Gatos, CA (US); Peter V. Jupin, Copenhagen (DK)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 16/538,655

(22) Filed: Aug. 12, 2019

Related U.S. Application Data

(60) Provisional application No. 62/736,409, filed on Sep. 25, 2018.

(51) Int. Cl.
*H04S 7/00* (2006.01)
*H04S 3/00* (2006.01)

(52) U.S. Cl.
CPC ..... *H04S 7/304* (2013.01); *H04S 3/008* (2013.01); *H04S 2400/01* (2013.01); *H04S 2420/01* (2013.01)

(58) Field of Classification Search
CPC ..... H04S 7/304; H04S 3/008; H04S 2400/01; H04S 2420/01
See application file for complete search history.

(56) References Cited

U.S. PATENT DOCUMENTS

| | | | |
|---|---|---|---|
| 9,955,279 | B2 | 4/2018 | Riggs et al. |
| 2015/0010160 | A1 | 1/2015 | Udesen |
| 2015/0312694 | A1 | 10/2015 | Bilinski et al. |
| 2016/0269849 | A1 | 9/2016 | Riggs et al. |

FOREIGN PATENT DOCUMENTS

| | | |
|---|---|---|
| WO | 2017158232 | 9/2017 |

*Primary Examiner* — Mark Fischer
(74) *Attorney, Agent, or Firm* — Womble Bond Dickinson (US) LLP

(57) ABSTRACT

An iterative method for finding which user characteristic data should be used for pruning a database of available HRTFs before selecting an HRTF from the database for a target user (target listener.) The selected HRTF is expected to be the one that is more suitable for target user. This is also referred to as having "personalized" the HRTF selection process for the target user. This is not about computing a suitable HRTF but rather how to use the user characteristic data to improve the chances of selecting the most appropriate one from a database of available HRTFs. Other aspects are also described and claimed.

21 Claims, 5 Drawing Sheets

HEAD RELATED TRANSFER FUNCTION SELECTION FOR BINAURAL SOUND REPRODUCTION

This non-provisional patent application claims the benefit of the earlier filing date of provisional application No. 62/736,409 filed Sep. 25, 2018.

An aspect of the disclosure here relates to digital audio systems that have 3D audio signal processing capability for binaural sound reproduction through headphones. Other aspects are also described.

BACKGROUND

Spatial hearing refers to the fact that when a sound is emanating from a discrete position, the acoustic signals arriving at a listeners ears not only travel on a direct path from the sound source to the ear-canal entrance, but they also arrive after reflecting and diffracting around the human anatomy causing acoustic artefacts. These artefacts, which are often different for left and right ears, give the listener cues to localize the sound. These features of sound transmission that are related to a listener can be encapsulated in a digital electronic data structure or dataset, referred to as a head-related transfer function (HRTF). A single HRTF is a pair of acoustic filters (one for each ear) which characterize the acoustic transmission from one position in a reflection-free environment to respective microphones placed in the ears of a listener at a given position or pose of the listener. An HRTF is used by a binaural simulation digital signal processing algorithm, to reproduce an audio recording as binaural sound, through driving a pair of headphones worn by a listener. The process uses the HRTF to create the illusion of a sound source somewhere in the environment. They encapsulate the fundamentals of spatial hearing.

Due to physiological differences between humans' ears, head and body, an HRTF is highly individualized. Binaural simulation using non-individualized HRTFs (for example, a listener auditioning a simulation using the HRTF dataset of another person) can cause audible problems in both the perceived position and quality (timbre) of the virtual sound.

There are a number of methods to achieve individualized HRTFs but these are often time-consuming or practically unfeasible when implemented in a consumer electronic device setting. When HRTF individualization is not possible, a generic HRTF is often used which aims to represent the 'average' HRTF. An HRTF dataset can be broken down into a set of underlying parameters such as inter-aural time difference (ITD), inter-aural level differences (ILD) and diffuse field HRTF (DF-HRTF). This information is useful in the individualization of an HRTF dataset. For example, an average HRTF could be created as a composite HRTF dataset that contains the ITDs from one person and the ILDs of another person. If enough of the features are personalized, the composite HRTF dataset should be indistinguishable from a measurement of their own HRTF dataset.

SUMMARY

An aspect of the disclosure here is an iterative method for finding which user characteristic data should be used for pruning a database of available HRTFs before selecting an HRTF from the database for a target user (target listener.) The selected HRTF is expected to be the one that is more suitable for target user. This is also referred to as having "personalized" the HRTF selection process for the target user. This is not about computing a suitable HRTF but rather how to use the user characteristic data to improve the chances of selecting the most appropriate one from a database of available HRTFs.

Another aspect of the disclosure is part of a method for producing binaural sound through headphones (while worn by a target user). First and second user characteristics of a target user, for whom a selection of an HRTF is to be made from a database of available HRTFs, are obtained. First and second subsets of the available HRTFs are then removed from consideration for the selection (based on the first and second user characteristics.) Advantageously, such a pruning process increases the likelihood that the selected HRTF will be a good one (due to fewer bad HRTFs remaining in the database.) An HRTF for the target user is then selected from the remaining members of the database of available HRTFs, and audio signals (user program audio) are then digitally processed by a binaural processor, according to the selected HRTF, to simulate binaural hearing (generating left and right transducer drive signals of the headphones.)

In some instances, an initial pruning operation may be performed (before the first and second subset are removed) in which a subset of the available HRTFs that are determined to be less generalizable or less generic than the rest of the available HRTFs are removed. This has also been shown to be effective in reducing the proportion of poor HRTFs in the database, helping improve the final selection odds of a good HRTF when combined with the subsequent first subset and second subset removals.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

General Concepts

Figure 1:
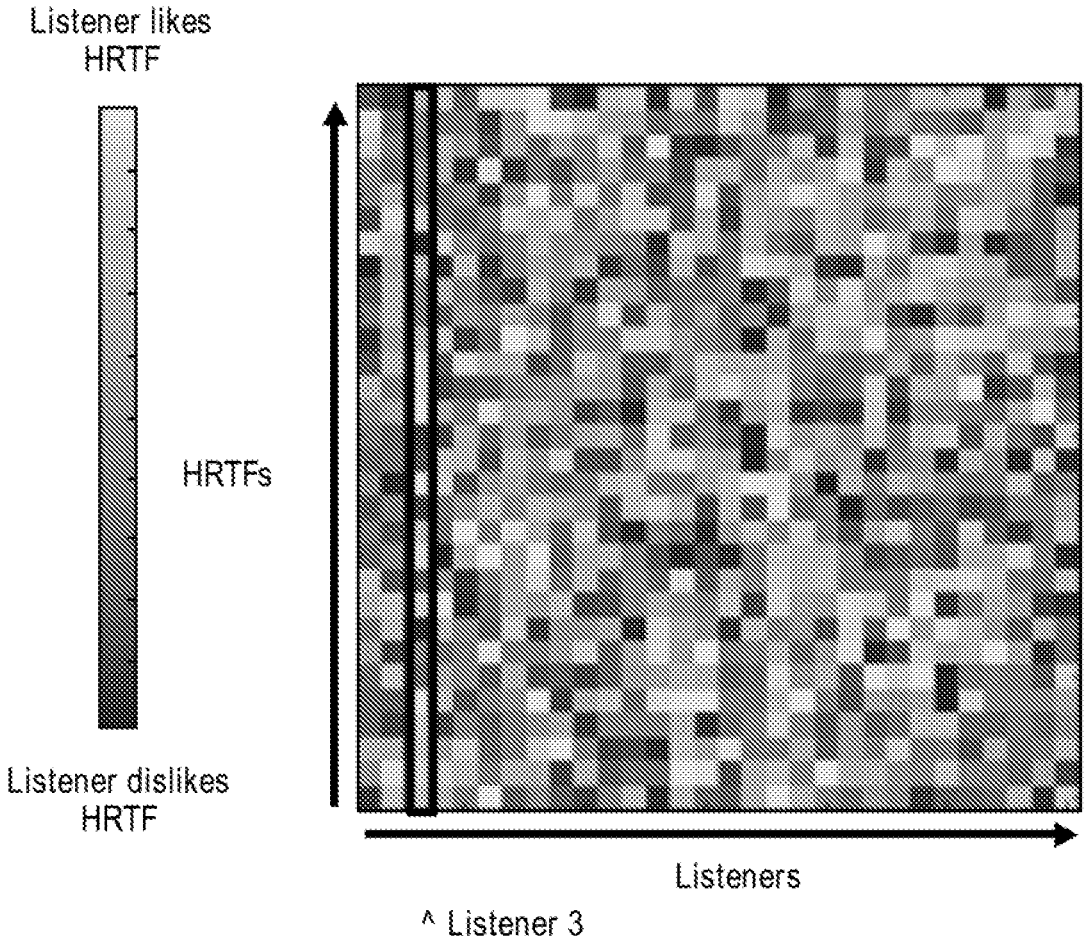
FIG. 1 illustrates an example ideal ratings matrix of how a group of listeners rate a group of HRTFs.

To help explain or illustrate the iterative method for finding which user characteristic data is more likely than others to predict the correct selection of an HRTF, let us first consider the 'ideal data' collected and presented as a matrix shown in FIG. 1, which shows how a group of listeners rate a group of HRTFs (in a range between "bad" or dislike, and "good" or like.) The different colors or shadings denote the magnitude or subjective approval rating by a listener, for a particular HRTF. The horizontal axis lists the various listeners, while the vertical axis lists the available HRTFs in a database. Each listener has ranked each HRTF, e.g., during a laboratory experiment where the same audio recording is reproduced as binaural sounds through the same type of headphones worn by the listener, using each of the available HRTFs. The results of these experiments may be plotted as a histogram shown in FIG. 2. That figure shows a histogram of how the HRTFs were ranked by listener #3: the x-axis is the subject approval rating range or scale, while the y-axis indicates how many of the available HRTFs were so ranked (at a particular subjective scale value.) As expected, the distribution for a particular listener (e.g., listener #3) shows very few HRTFs as being good matches for listener #3.

Ideally, if the matrix in FIG. 1 were known for every listener, then it would be a simple matter of selecting one of the highest ranked HRTFs in listener #3's column as the appropriate HRTF for the listener #3. In reality, such data is not known for a random user who purchases the audio system (that has 3D audio signal processing capability for binaural sound reproduction.) Continuing with the example of listener 3, if little or nothing is known about this listener, and if an HRTF is selected at random from those available in the database, then the probability of having selected the right HRTF may be computed from the histogram in FIG. 2.

Finding the Characteristic Data

Figure 2:
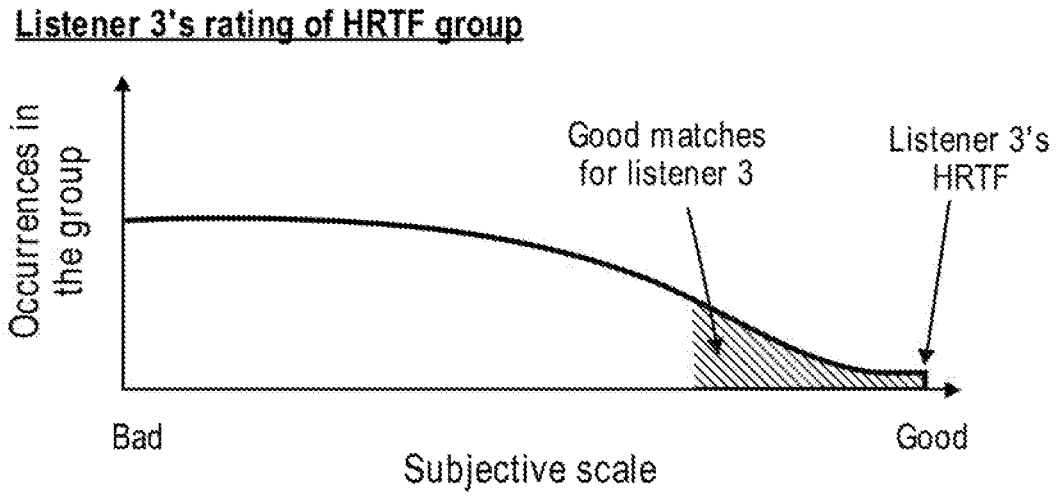
FIG. 2 shows a histogram of the subject approval ratings by a particular listener for the group of HRTFs.

A goal here is to ensure that an HRTF that has been selected for listener #3 is closer to the 'good' rating region (see FIG. 2.) For an unknown listener, their HRTF preference subjective ratings are not known directly, but if we can find other pieces of information that correlate well with such subjective ratings, then this information can be used to improve our selection of an HRTF (for a given listener), based on a precomputed model. This information which is used to predict HRTF preference data is referred to here as characteristic data.

Figure 3:
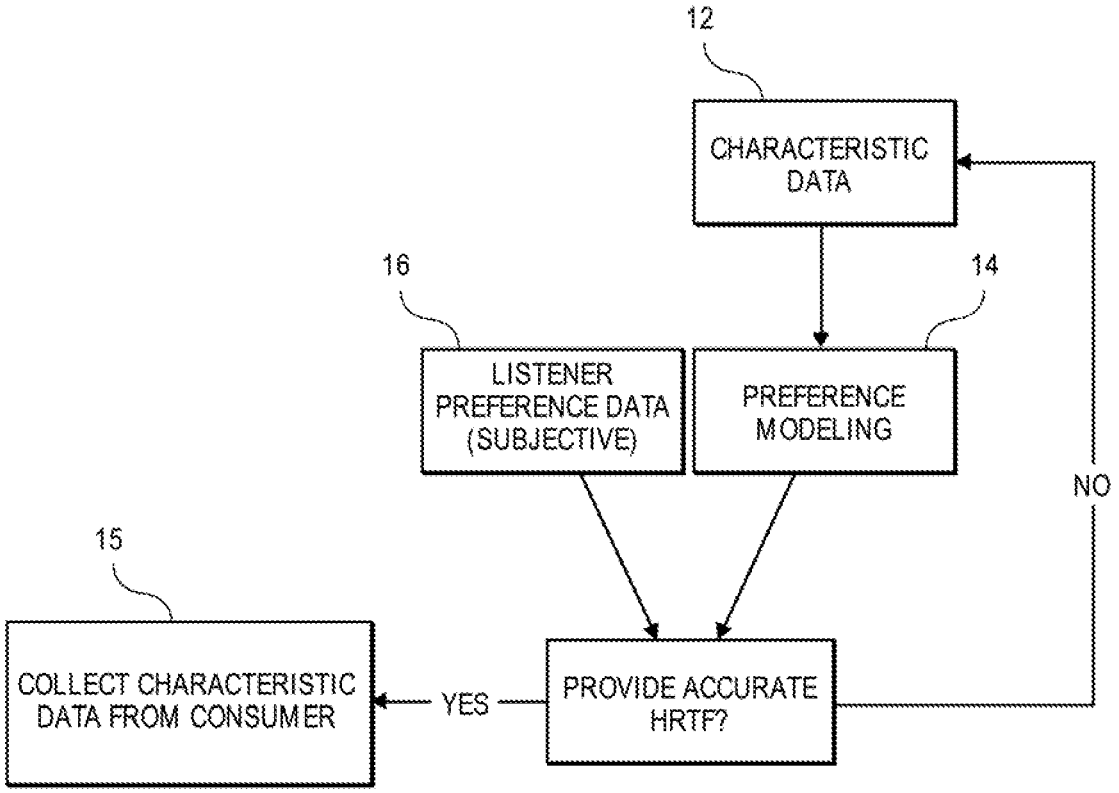
FIG. 3 depicts a block diagram of an iterative procedure to find which characteristic data can be used to improve HRTF selection.

FIG. 3 shows an iterative process to identify which is the "best" characteristic data that should be collected from an unknown listener (based on which HRTF selections are then made for any given listener.) The process may begin with operation 12, where for example an analyst (a person having ordinary skill in the art of HRTF analysis) picks a first characteristic data element (from a list of possible elements that are believed to be factors in how different individuals have different HRTFs.) The list of possible elements can be found in the literature, and more may be added based on future experimental data. A preference model is created in operation 14 that uses the initial characteristic data element (e.g., listener gender) to analyze and select a number of HRTFs from a database of available HRTFs, using subjective listener preference data. For example, if the subjective listener preference data (subject approval ratings) indicate that a certain handful of HRTFs are ranked highly by listeners that have the specified initial characteristic data, e.g., high school students, and this confirms the preference modeling 14, then the first characteristic data element is flagged as being one that should be collected from an unknown listener. But if the preference modeling 14 fails to confirm a correlation between the first characteristic data element and a particular group of HRTFs, then the process loops back to operation 12 where the first characteristic data element is replaced by a second element or is enhanced by the addition of another element (e.g., high school freshman, high school seniors.) This process continues until a set of characteristic data elements have been found that correlate well with the experimental subject ratings provided by various listeners. In other words, this process can evaluate which combinations of characteristic data best predict subjective listening preference. A suitable set of characteristic data elements which might correlate well with subjective ratings of HRTFs include (but need not be limited to)

- listener gender
- listener age
- listener height
- single or multiple acoustic measurements at the ears of the listener (e.g., where a particular sound is binaurally simulated into the headphones that are worn by the listener and the listener describes what they hear)
- continuous binaural recordings at the ears of a listener (e.g. recordings made using microphones in the left and right headphones while a particular directional sound source is emitting)
- photograph of the listener's ear Producing Binaural Sound for an Unknown Target Listener A goal here is to produce pleasant binaural sound to a target user (target listener), for whom a selection of an HRTF is to be made from a database of available HRTFs. The sound production may by through for example headphones (transducers placed at the ears of the target user.) This will be done by improving the chances of selecting a "good" HRTF, from a database of available HRTFs, which results in better binaural sound simulation for the target user in particular. The method may proceed as follows, with reference to the diagrams in FIGS. 4A-4C. Note that this process is robust in that it could start with having no information about the target user. In addition, the database of available HRTFs need not have been pruned yet. In other words, in one embodiment of the invention, no members of the database of available HRTFs have been removed from consideration, based on knowledge of characteristic data that are specific to the target user (e.g., gender, race, age range, or height range.) At this early stage of the method therefore, the method can be described as having no knowledge of the target users gender, race, age range, and height range (as well as perhaps other characteristic data elements or anthropometric characteristics of the target user such as which audio product the target user has just purchased that is to be fitted with a selected HRTF, the country or broader political region of purchase, residence information of the target user, etc.)

Figure 4A:
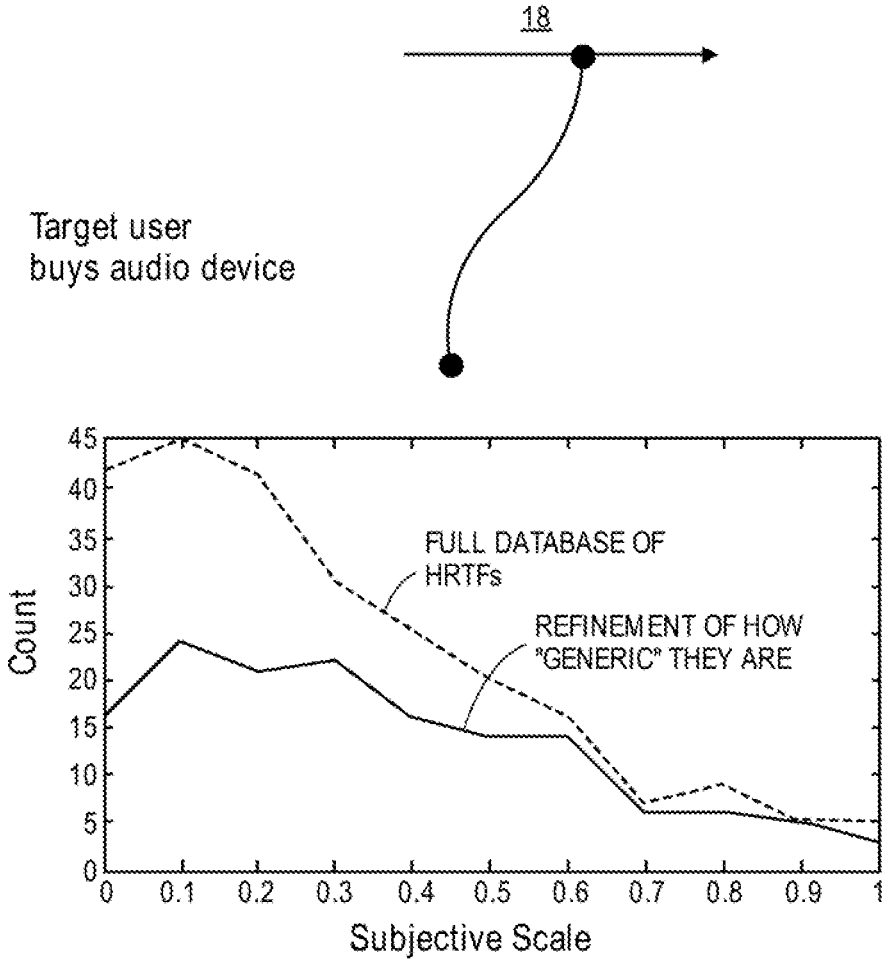
FIGS. 4A-4C illustrate the flow of an example improved process for producing binaural sound for an unknown target listener.

The method may begin with operation 18 in FIG. 4A, removing a subset of the available HRTFs where the subset is determined to be less generalizable or less generic than the rest of the available HRTFs in the database or group. For example, the HRTFs that are believed to be statistical outliers, in terms of their subjective rankings given by a population of listeners, may be removed from the database. In addition, HRTFs that are determined to have subjective approvals that are lower than a threshold are removed.

Alternatively, one could retain only those HRTFs that have subjective approvals that are higher than a threshold. This operation thus serves to reduce the available HRTFs in the database, from which a first subset and a second subset are further removed in operations 20 and 22 described below.)

This initial refinement or pruning of the database resulted in the histogram of measured subjective preference ratings, by a single listener, for the remaining database members, changing as shown in the plot of FIG. 4A, to what is referred to here as a refinement histogram curve. The refinement curve reflects the improved generic-ness of the remaining HRTFs in the database. To reiterate, the histogram shows how many HRTFs were ranked by a given listener (eat each subject ranking value (where 0 is poor or "bad" and 1 is "good.") Here it is interesting to note that the number of HRTFs that are in a bad region, e.g., between 0 and 0.3, has declined significantly, while those that are in a good region, e.g., between 0.7 and 1.0, have remained stable. This suggests an improvement in the likelihood that any randomly selected HRTF, from this reduced group, will be a good one.

Figure 4B:
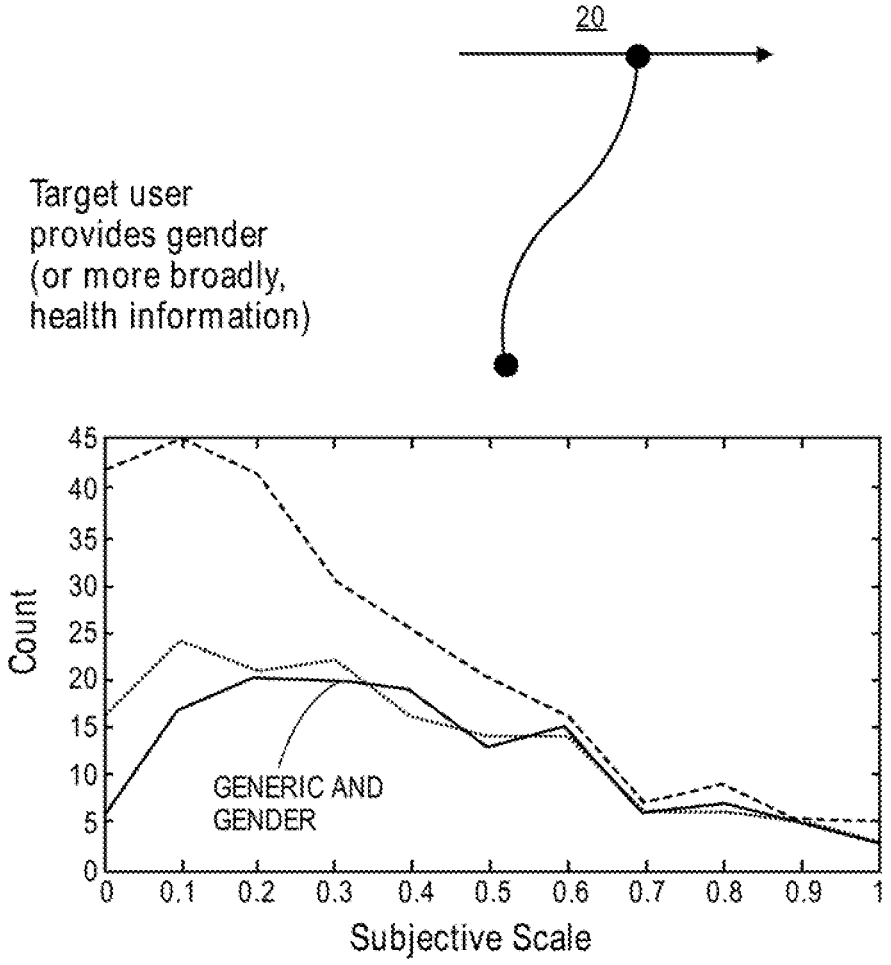

The method may continue with operation 20 in FIG. 4B, obtaining a first user characteristic of the target user and removing (from consideration for the selection) a first subset of the remaining, available HRTFs, based on the first user characteristic. Again, this is designed to reduce the available HRTFs in the database, by reducing the number of bad HRTFs while maintaining the count of HRTFs in the good region of the subjective scale. A further improvement in the histogram was seen as shown, when the characteristic data element of the target user was the target user's gender. As an example of removing the first subset (based on the first user characteristic), one can determine which ones of the available HRTFs have a subject approval or preference rating, by a listener group of one or more listeners that has the first user characteristic, that is lower than a threshold. In this example, all HRTFs that are ranked less than 0.3 by those who identify themselves as female could be part of the first subset that is removed.

More generally the first user characteristic in operation 20 could be selected from the group consisting of: gender, race, age range, and height range. The user characteristic could be obtained by retrieving a predetermined characteristic from a data storage that is i) remotely accessed or ii) local memory of the audio device that is generating the transducer drive signals, wherein the predetermined characteristic is part of personal information data of the target user, e.g., health information of the target user.)

Figure 4C:
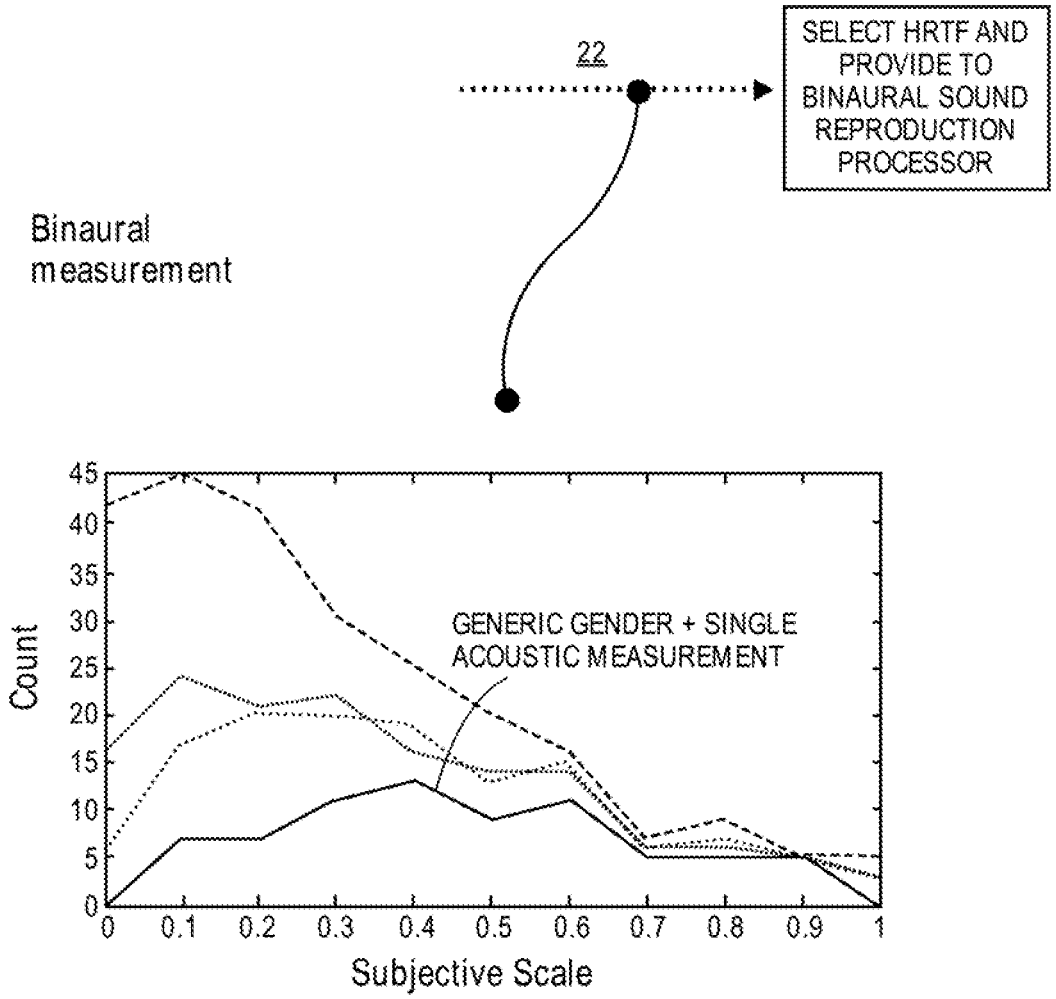

The method may continue with operation 22 in FIG. 4C, obtaining a second user characteristic of the target user and removing from consideration for the selection, a second subset of the available HRTFs (based on the second user characteristic.)

The experimental results for such an operation (as performed in a laboratory setting) are plotted in the graph of FIG. 4C and show a further improvement in the histogram of subject preference ratings by the given listener. It is thus clear that the process encompassing operations 20-22, coupled with the initial pruning in operation 18 that is based on generic-ness, has removed many of the HRTFs that have low subject ratings (the count has significantly decreased in the poor region below 0.3, while the count in the good region above 0.7 has remained fairly steady. For this particular example, the second user characteristic can be a single binaural measurement taken by an audio device that is generating the transducer drive signals for the headphones that are being worn by the target user, or it can be a binaural measurement that was made previously by another audio device worn by the target user and that has been imported for the present use. Additional binaural measurements may be taken and used to further prune the HRTF database.

In one embodiment, the process may continue with additional pruning operations (after removing the first subset and the second subset as described above), until reaching a point where a decision is made that the remaining group of HRTFs in the database is small enough, and to select an HRTF for the target user (from remaining members of the database of available HRTFs.) In one embodiment, the HRTF is selected by determining which one of the remaining members has a highest approval rating by a listener group of one or more listeners that has the first user characteristic and the second user characteristic. Other ways of selecting the HRTF from the remaining database are possible. Next, the digital audio signals of the target user's program audio are then processed by a binaural processor according to the selected HRTF, to generate the transducer drive signals that drive the transducers that are placed at the ears of the target user.

While certain aspects have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

The invention claimed is:

1. A method for producing binaural sound through the use of transducers placed at the ears of a target user, the method comprising:

a) obtaining a first user characteristic of a target user, for whom a selection of an HRTF is to be made from a database of available HRTFs;

b) removing, from consideration for the selection, a first subset of the available HRTFs, based on the first user characteristic;

c) obtaining a second user characteristic of the target user;

d) removing from consideration for the selection, a second subset of the available HRTFs, based on the second user characteristic;

e) selecting an HRTF for the target user from remaining members of the database of available HRTFs after removing the first subset and the second subset; and f) processing a plurality of audio signals according to the selected HRTF, to generate a plurality of transducer drive signals that drive the transducers that are placed at the ears of the target user.

2. The method of claim 1 wherein before a), no members of the database of available HRTFs have been removed from consideration, based on knowledge of the target user gender, race, age range, or height range.

3. The method of claim 1 wherein before a), no members of the database of available HRTFs have been removed from consideration, based on knowledge of anthropomorphic characteristics of the target user.

4. The method of claim 1 further comprising:

removing a subset of the available HRTFs that are determined to be less generalizable than the rest of the available HRTFs, to reduce the available HRTFs in the database from which the first subset and the second subset are removed in b) and d).

5. The method of claim 1 further comprising removing a subset of the available HRTFs that are determined to have subjective approvals that are lower than a threshold, to reduce the available HRTFs in the database from which the first subset and the second subset are removed in b) and d).

6. The method of claim 1 wherein the first user characteristic is selected from the group consisting of: gender, race, age range, and height range.

7. The method of claim 6 wherein the second user characteristic is a binaural measurement taken by an audio device that is generating the transducer drive signals.

8. The method of claim 6 wherein the second user characteristic is a previously made binaural measurement.

9. The method of claim 6 wherein obtaining the first user characteristic comprises retrieving a predetermined characteristic from a data storage that is i) remotely accessed or ii) local memory of the audio device that is generating the transducer drive signals, wherein the predetermined characteristic is part of personal information data of the target user.

10. The method of claim 1 wherein obtaining the first user characteristics comprises retrieving a predetermined characteristic from a data storage that is i) remotely accessed or ii) local memory of an audio device that is generating the transducer drive signals, wherein the predetermined characteristic is part of personal information data of the target user.

11. The method of claim 1 wherein removing, from consideration for the selection, a first subset of the available HRTFs, based on the first user characteristic comprises determining those ones of the available HRTFs have a subject approval rating, by a listener group of one or more listeners that has the first user characteristic, that is lower than a threshold, and removing those ones as the first subset.

12. The method of claim 1 wherein removing, from consideration for the selection, a second subset of the available HRTFs, based on the second user characteristic comprises determining those ones of the available HRTFs have a subject approval rating, by a listener group of one or more listeners that has the second user characteristic, that is lower than a threshold, and removing those ones as the first subset.

13. The method of claim 1 wherein selecting an HRTF for the target user, from remaining members of the database of available HRTFs after removing the first subset and the second subset, comprises determining which one of the remaining members has a highest approval rating by a listener group of one or more listeners that has the first user characteristic and the second user characteristic.

14. An audio system for producing, from a plurality of audio signals, binaural sound through transducers placed at the ears of a user, the audio system comprising a processor and memory having stored therein instructions that when executed by the processor:

a) obtain a first user characteristic of a target user, for whom a selection of an HRTF is to be made from a database of available HRTFs;

b) remove, from consideration for the selection, a first subset of the available HRTFs, based on the first user characteristic;

c) obtain a second user characteristic of the target user;

d) remove from consideration for the selection, a second subset of the available HRTFs, based on the second user characteristic;

e) select an HRTF for the target user from remaining members of the database of available HRTFs after removing the first subset and the second subset; and f) process a plurality of digital audio signals according to the selected HRTF, to generate a plurality of transducer drive signals that drive the transducers that are placed at the ears of the target user.

15. The audio system of claim 14 wherein before a), no members of the database of available HRTFs have been removed from consideration, based on knowledge of the target user gender, race, age range, or height range.

16. The audio system of claim 14 wherein before a), no members of the database of available HRTFs have been removed from consideration, based on knowledge of anthropomorphic characteristics of the target user.

17. The audio system of claim 14 wherein the processor is to remove a subset of the available HRTFs that are determined to be less generalizable than the rest of the available HRTFs, to reduce the available HRTFs in the database from which the first subset and the second subset are removed in b) and d).

18. The audio system of claim 14 wherein the processor is to remove a subset of the available HRTFs that are determined to have subjective approvals that are lower than a threshold, to reduce the available HRTFs in the database from which the first subset and the second subset are removed in b) and d).

19. The audio system of claim 14 wherein the processor, to remove from consideration for the selection a first subset of the available HRTFs, based on the first user characteristic, does so by determining those ones of the available HRTFs have a subject approval rating, by a listener group of one or more listeners that has the first user characteristic, that is lower than a threshold, and removing those ones as the first subset.

20. The audio system of claim 14 wherein the processor, to remove from consideration for the selection a second subset of the available HRTFs, based on the second user characteristic, does so by determining those ones of the available HRTFs have a subject approval rating, by a listener group of one or more listeners that has the second user characteristic, that is lower than a threshold, and removing those ones as the first subset.

21. The audio system of claim 14 wherein the processor, to select an HRTF for the target user from remaining members of the database of available HRTFs after removing the first subset and the second subset, does so by determining which one of the remaining members has a highest approval rating by a listener group of one or more listeners that has the first user characteristic and the second user characteristic.

* * * * *